US006934998B1

(12) United States Patent
Shuler

(10) Patent No.: US 6,934,998 B1
(45) Date of Patent: Aug. 30, 2005

(54) SASH BALANCE SHOE JAMB ATTACHMENT

(75) Inventor: Leonard Dale Shuler, Alderson, WV (US)

(73) Assignee: Pomeroy Incorporated, Dubuque, IA (US)

( * ) Notice: Subject to any disclaimer, the term of this patent is extended or adjusted under 35 U.S.C. 154(b) by 5 days.

(21) Appl. No.: 10/823,925

(22) Filed: Apr. 14, 2004

Related U.S. Application Data

(60) Provisional application No. 60/462,893, filed on Apr. 15, 2003.

(51) Int. Cl.[7] ..... E05D 13/00

(52) U.S. Cl. ..... 16/193; 16/196; 16/202; 16/207; 16/2.1

(58) Field of Search ..... 16/193, 194, 196, 16/202, 208, 207, 210, 404, 220, 2.1; 49/445, 49/447

(56) References Cited

U.S. PATENT DOCUMENTS

| | | | | | |
|---|---|---|---|---|---|
| 179,160 | A | * | 6/1876 | Chase | 16/202 |
| 332,773 | A | * | 12/1885 | Oberndorfer | 16/202 |
| 333,775 | A | * | 1/1886 | Altick | 16/207 |
| 399,216 | A | * | 3/1889 | Spencer | 16/202 |
| 500,760 | A | * | 7/1893 | Gerhardt | 16/207 |
| 521,806 | A | * | 6/1894 | Mullikin | 16/207 |
| 590,749 | A | | 9/1897 | Zea | |
| 637,402 | A | | 11/1899 | Mulder | |
| 817,039 | A | * | 4/1906 | Broome | 16/203 |
| 873,623 | A | * | 12/1907 | Smith | 16/207 |
| 977,247 | A | * | 11/1910 | Woerner | 16/207 |
| 1,107,010 | A | * | 8/1914 | Allen et al. | 16/209 |
| 1,336,030 | A | | 4/1920 | Gammeter | |
| 1,390,561 | A | * | 9/1921 | Kelly | 40/553 |
| 2,346,846 | A | | 4/1944 | Isaacs | |
| 4,261,410 | A | * | 4/1981 | Standiford | 160/269 |
| 6,145,170 | A | * | 11/2000 | Bernard et al. | 24/298 |

FOREIGN PATENT DOCUMENTS

| | | | | |
|---|---|---|---|---|
| JP | 07275020 | A * | 10/1995 | A44C 27/00 |

* cited by examiner

*Primary Examiner*—Chuck Y. Mah
*Assistant Examiner*—Mark Williams
(74) *Attorney, Agent, or Firm*—Robert A. Seemann

(57) ABSTRACT

A sash balance shoe that draws an extending cord to the shoe by an elastic mechanism in the shoe is hung from a wall of a vertical track of a window jamb by the cord extending through the axis of a convex face of a radially extending annular wall that is on one end of a leg that passes through a hole in the track wall and is prevented from exiting from the hole by the diameter of the annular wall being larger than the diameter of the hole and by a radially extending annular ridge that is larger in diameter than the diameter of the hole and is beveled and flexible enough for insertion into the hole.

13 Claims, 5 Drawing Sheets

SASH BALANCE SHOE JAMB ATTACHMENT

This application claims the benefit of U.S. Provisional Application No. 60/462,893, filed Apr. 15, 2003.

BACKGROUND OF THE INVENTION

1. Field of the Invention

The invention pertains to mounting of cord or string supported sash balances, more particularly to fixed attachment of one end of a sash balance shoe support cord to a window jamb.

2. Description of the Prior Art

In one prevalent prior art arrangement, the end of a cord that is spring tensioned on the shoe, is attached to the jamb or window frame by a screw to which the end of the cord is tied. This arrangement requires at least two hands to install, and can result in thread stripping and a cocked screw head that interferes with shoe travel if the screw is in the jamb's shoe track.

In another prior art arrangement, the end of the cord that extends from the shoe is attached to a hook that hooks into a hole, usually an oblong hole, in the jamb. This arrangement is more convenient to install than a screw, but the hook is sometimes dislodged from the jamb by catching the passing shoe, or when tension is momentarily lost in the cord.

SUMMARY OF THE INVENTION

It is one object of the invention to provide a fastener for a spring tensioned cord emanating from a sash balance shoe, that fastens in a hole in the jamb along which the shoe travels.

It is another object of the invention that the fastener and cord does not prevent movement of the shoe past the fastener.

It is another object of the invention that the fastener and cord cannot be dislodged from the jamb by movement of the shoe across the fastener.

It is another object of the invention that the fastener is tightened in the hole by movement of the shoe across the fastener.

It is another object of the invention that the fastener is tightened in the hole by tension of the cord in any radial direction normal to the axis of the hole in the jamb.

Other objects and advantages will become obvious to one reading the ensuing description of the invention.

This application claims the benefit of U.S. Provisional Application No. 60/462,893, filed Apr. 15, 2003 which is hereby incorporated herein in its entirety by reference.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
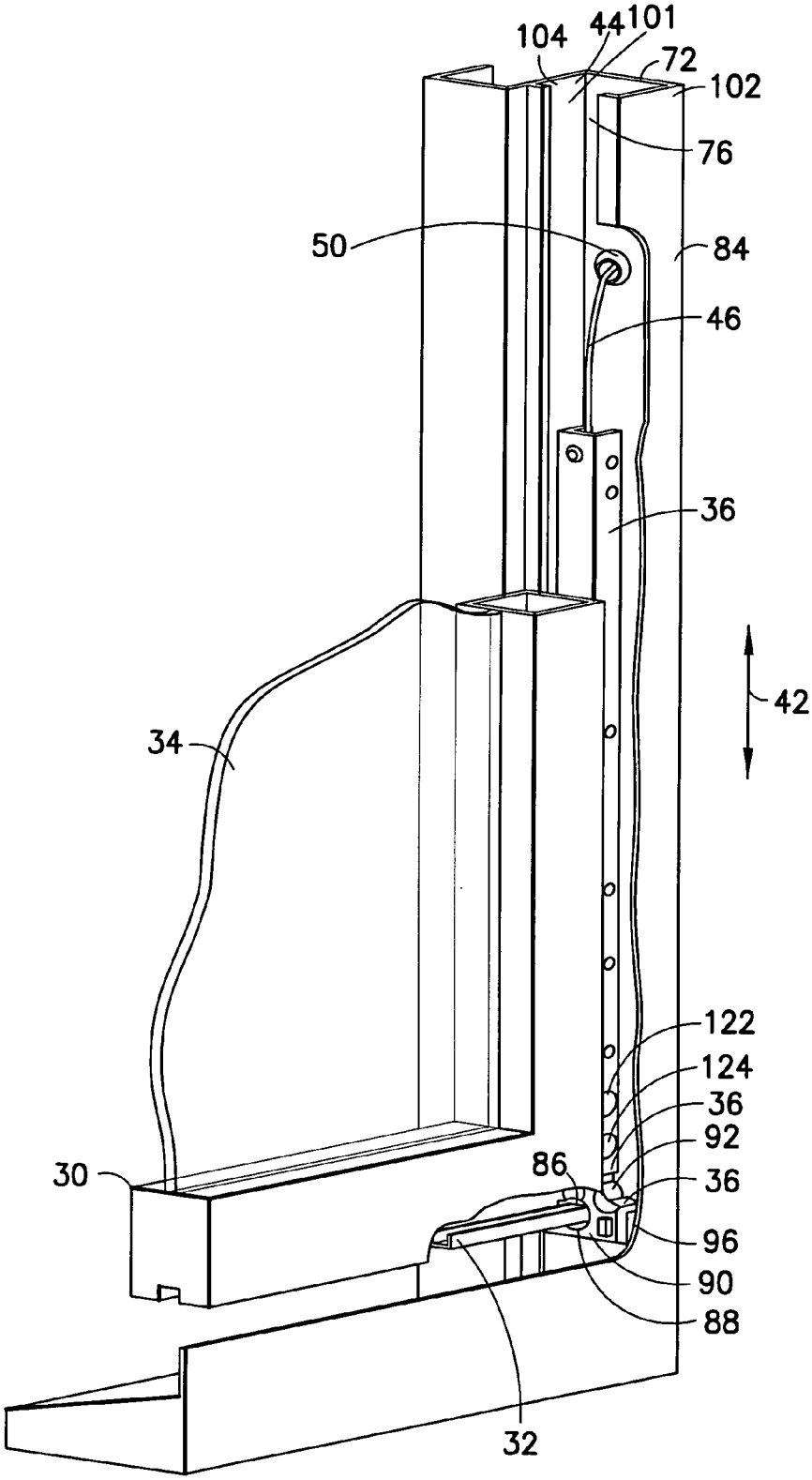
FIG. 1 is a front perspective view of a sash mounted on a sash balance attached to a window jamb balance travel track by a cord and fastener according to the invention. The balance is below the fastener.
Figure 2:
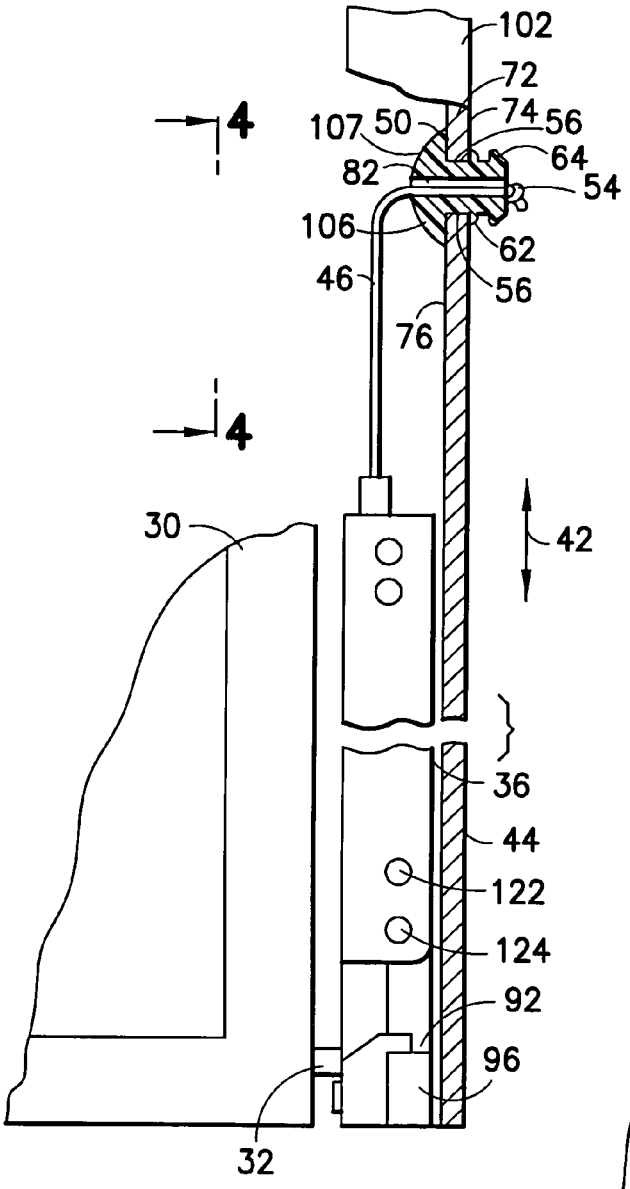
FIG. 2 is a front schematic view of the sash, balance, track and jamb of FIG. 1, showing the jamb in cross section.
Figure 3:
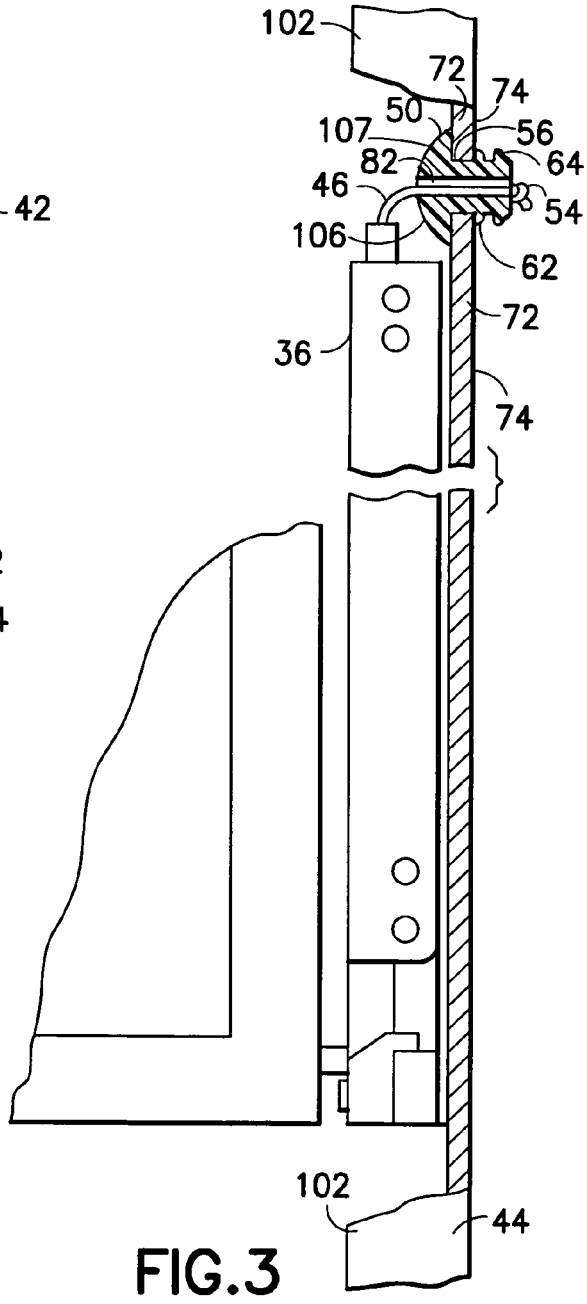
FIG. 3 is a front schematic view of the elements in FIG. 2, in which the balance is passing across the fastener.
Figure 6:
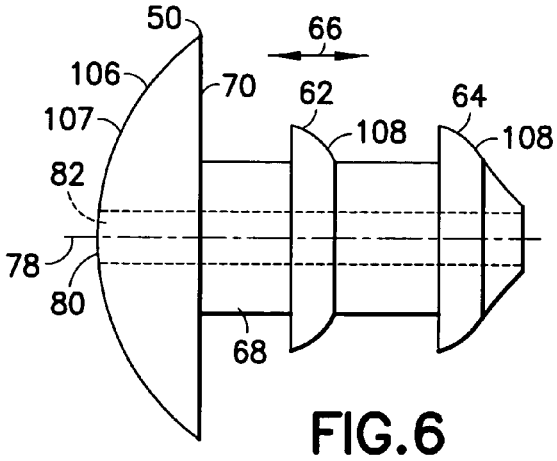
FIG. 6 is a front view of the fastener of FIG. 2.
Figure 4:
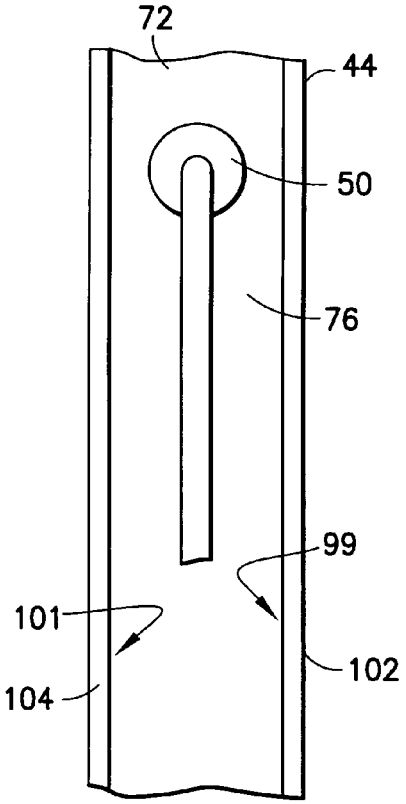
FIG. 4 is a side schematic view taken along 4—4 in FIG. 2, of the cord attached to the jamb by the fastener.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–4 and 6, sash 30 containing lights 34 is mounted by pivot bar 32 on shoe 36. Shoe 36 moves vertically 42 on track 44, supported vertically by cord 46 which extends through one-piece fastener 50 by way of axial hole 82 and is formed into knot 54 which prevents withdrawal of the cord from the fastener.

Fastener 50 extends through circular hole 56 in jamb 84. Fastener 50 is preferably molded plastic. Fastener 50 is preferably molded in one piece. Ridges 62 and 64 on leg 68 are spaced 66 axially from surface 70 of head 107. Ridge 64 extends radially outside the hole over surface 74 of wall 72 of track 44 when surface 70 abuts on surface 76 of wall 72 of the track.

Preferably there are at least two ridges spaced so that at least one of the ridges extends radially outside the hole over surface 74 of wall 72 of track 44 when surface 70 abuts on surface 76 of wall 72 of the track.

A cord pulling radially with respect to axis 78 in any angular direction within the 360 degree arc about the axis, at end 80 of hole 82 through fastener 50 is prevented from dislodging fastener 50 from hole 56 by the ridge that extends over surface 74. Also, a radially pivoting force about a first ridge that is in hole 56 between surfaces 74, 76 causes a second ridge, if in the hole, to grip the inner surface of the hole, and if outside the hole to resist withdrawal of the second ridge from surface 74. Convex surface 106 cams with the shoe, exerting an increasing insertion force on fastener 50 when the shoe passes across convex surface. The passing shoe cannot knock the fastener out of hole 56.

The ridges are beveled 108 and flexible enough so that leg 68 can be inserted into hole 82.

Referring to FIGS. 1–5, when shoe 36 is in track 44, rotating a sash pivot bar that extends into oblong opening 86 of metal cam 88 rotates the cam so that arms 92, 94 of plastic brake element 90 move apart forcing brake surfaces 96, 98 to bear against inward facing surfaces 99, 101 of walls 102, 104. Brake element 90 is fastened in a metal U-shaped channel by cross bar rivets 122, 124.

Cord 46 supports shoe 36 by way of spring loaded 112 block and tackle 114 which draws 52 the cord to the shoe.

Figure 7:
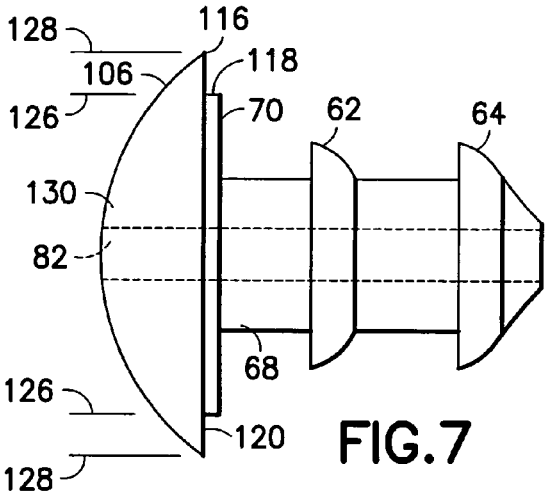
FIG. 7 is a front view of another fastener of the invention.
Figure 8:
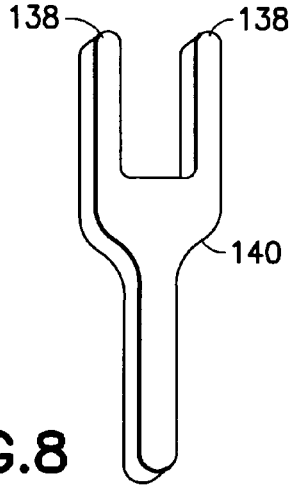
FIG. 8 is a front perspective view of a prying tool for removing a fastener of the invention.
Figure 5:
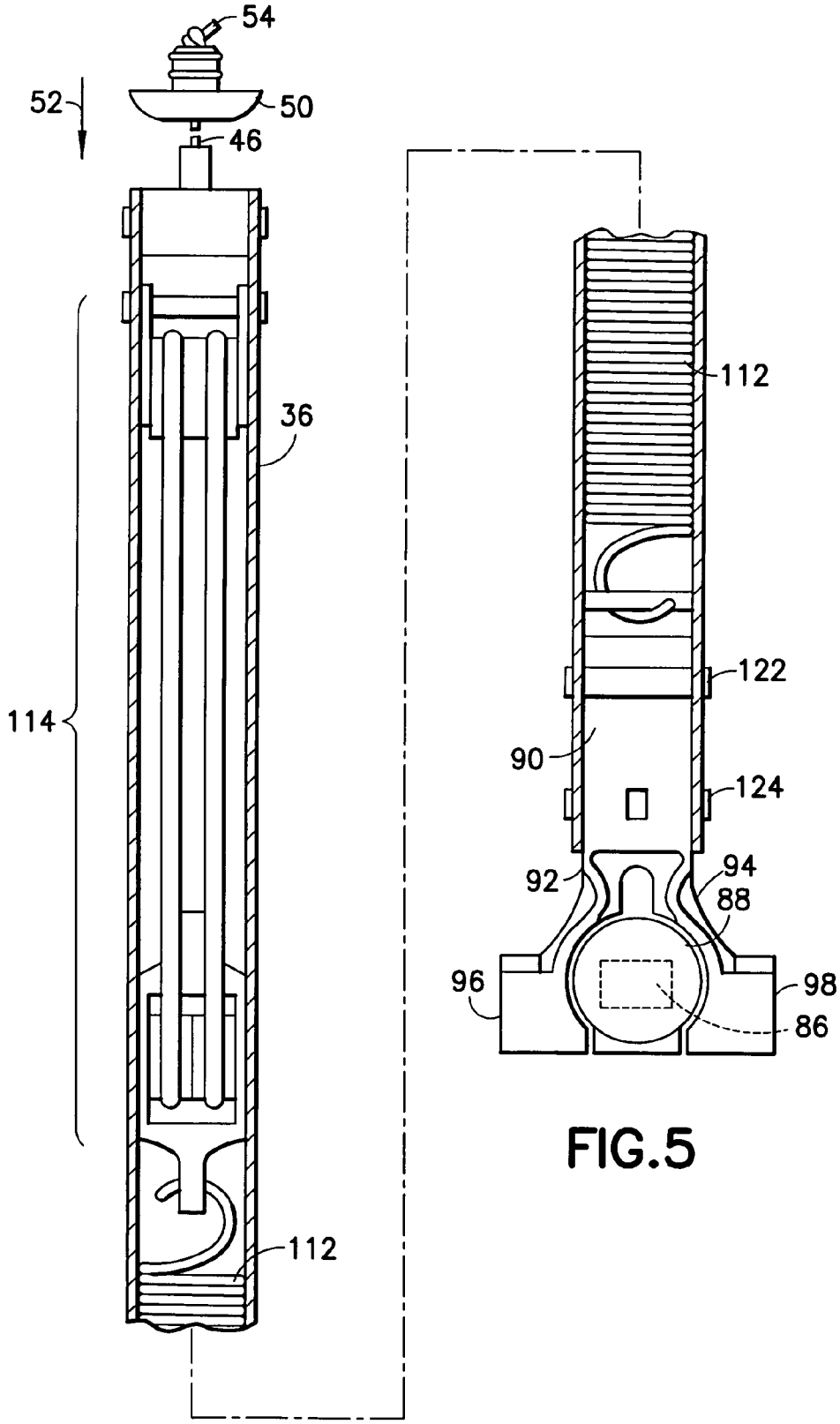
FIG. 5 is a side schematic view of the shoe, cord and fastener of FIG. 2.

Referring to FIGS. 7 and 8, in fastener 116, like elements to elements in fastener 50 have the same numerals as fastener 50. Annular shoulder 118 having a smaller diameter 126 than maximum diameter 128 of head 130 provides annular axially facing surface 120 for prying fastener 116 out of hole 56 by inserting fingers 138 of steel prying tool

140 between surface 120 and surface 76 of wall 72 of the track when fastener 116 is in hole 56.

Figure 9:
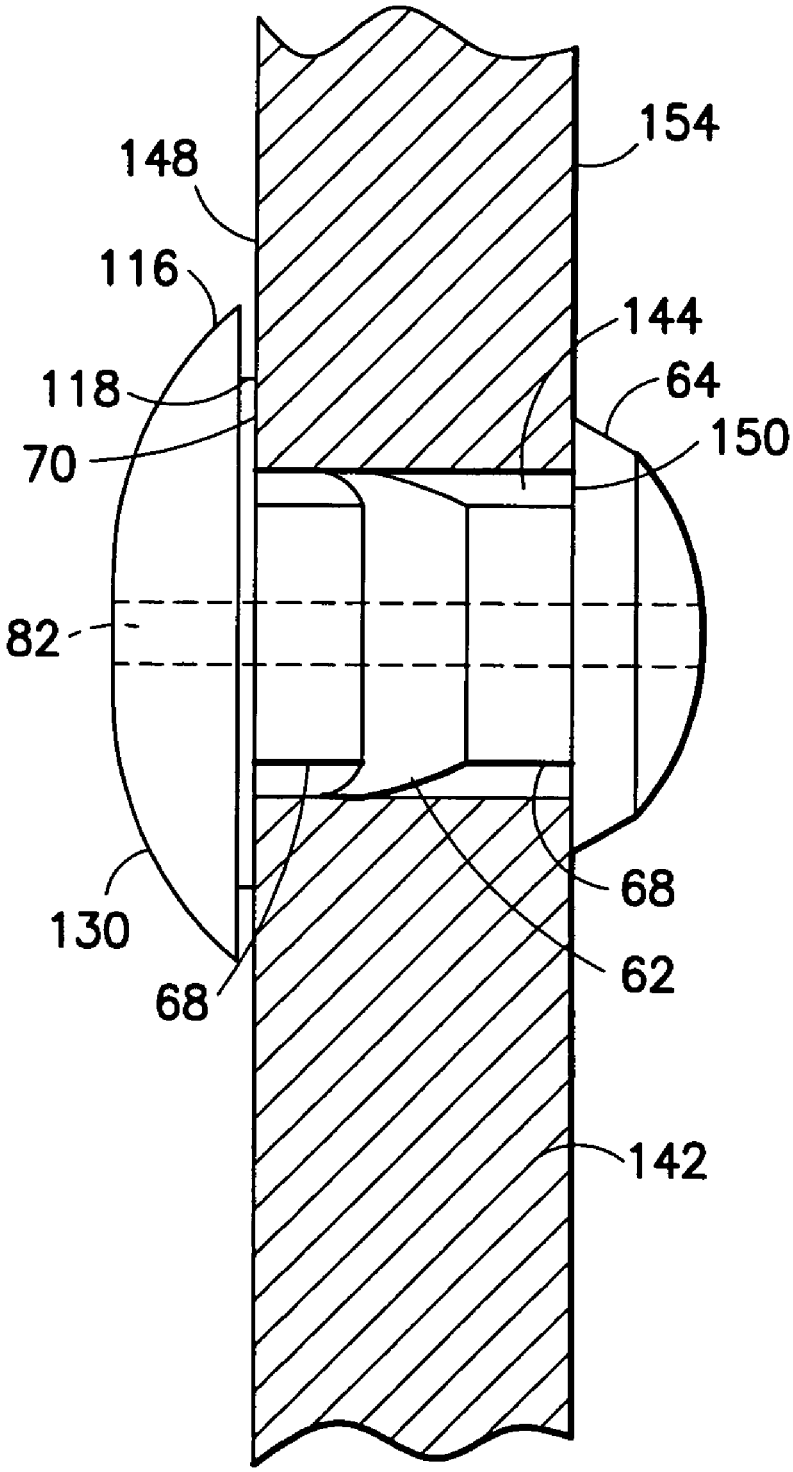
FIG. 9 is a front schematic view of the fastener of FIG. 7, in another jamb.

Referring to FIG. 9, ridge 62 is bent toward leg 68 and toward head 130 by the annular wall of hole 144 when fastener 116 is pressed, ridge 64 first, into hole 144 in wall 142. Ridge 64 springs radially outward after ridge 64 passes through the hole. Surface 70 stopping against surface 148 of the wall prevents pushing the fastener through the wall. Surface 150 of ridge 64 prevents withdrawal of the fastener from the wall when surface 150 comes up against surface 154 of the wall when the fastener is pulled from head 130 side of the fastener.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (Informal List)

30 sash
32 pivot bar
34 lights
36 shoe
42 vertically, direction arrow
44 track
46 cord
50 fastener
52 draws
54 knot
56 hole, circular
62 ridge
64 ridge
66 spaced axially
68 leg
70 surface
72 wall
74 surface
76 surface
78 axis
80 end of opening 82
82 hole through fastener
84 jamb
86 oblong opening
88 cam
90 brake element
92 arm
94 arm
96 brake surface
98 brake surface
99 inward facing surface
101 inward facing surface
102 wall
104 wall
106 convex surface
107 head of fastener 50
108 beveled
112 spring
114 block and tackle
116 fastener
118 shoulder
120 surface
122 rivet
124 rivet
126 diameter
128 diameter
130 head
138 finger
140 prying tool
142 wall
144 hole through wall 142
148 surface
150 surface
154 surface

What is claimed is:

1. In a window jamb:

a sash balance shoe comprising a cord extending from said shoe drawn toward said shoe by an elastic mechanism hanging from a first wall of a vertical track of said jamb by said cord extending axially through a convex face of a radially extending annular second wall that is on one end of a fastener leg passing axially through a hole in the wall of the vertical track, said leg prevented from exiting from said hole by a diameter of said annular second wall being larger than said hole and by a radially extending annular ridge on said leg, said ridge having a diameter that is larger than said hole and being beveled and flexible enough for insertion through said hole, said cord extending axially through said leg.

2. The window jamb of claim 1 comprising:

said radially extending annular second wall extending over and configured for contacting a first side of the wall of the vertical track, and said annular ridge extending over and configured for contacting a second side of the first wall of the vertical track.

3. In a window jamb:

a sash balance shoe comprising a cord extending from said shoe drawn toward said shoe by an elastic mechanism hanging from a first wall of a vertical track of said jamb by said cord extending axially through a convex face of a radially extending annular second wall that is on one end of a fastener leg passing axially through a hole in the wall of the vertical track, said leg prevented from exiting from said hole by a diameter of said annular second wall being larger than said hole and by a radially extending annular ridge on said leg, said ridge having a diameter that is larger than said hole and being spaced from said radially extending annular second wall and beveled and flexible enough for insertion through said hole, said cord extending axially through said leg, said annular second wall, said leg and said ridge formed in one piece of plastic.

4. In a window jamb:

a sash balance shoe comprising a cord extending from said shoe drawn toward said shoe by an elastic mechanism hanging from a first wall of a vertical track of said jamb by said cord extending axially through a convex face of a radially extending annular second wall that is on one end of a fastener leg passing axially through a hole in the wall of the vertical track, said leg prevented from exiting from said hole by a diameter of said annular second wall being larger than said hole and by a radially extending annular ridge on said leg, said ridge having a diameter that is larger than said hole and being spaced from said radially extending annular second wall and beveled and flexible enough for insertion through said hole, said convex face being radially larger than the hole, said cord extending axially through said leg, said annular second wall, said leg and said ridge formed in one piece of plastic.

5. In a window jamb:

a sash balance shoe comprising a cord extending from said shoe drawn toward said shoe by an elastic mechanism hanging from a first wall of a vertical track of said jamb by said cord extending axially through a convex face of a radially extending annular second wall that is on one end of a fastener leg passing axially through a hole in the wall of the vertical track, said leg prevented from exiting from said hole by a diameter of said annular second wall being larger than said hole and by a radially extending first annular ridge on said leg, said ridge having a diameter that is larger than said hole and being spaced from said radially extending annular second wall and flexible enough for insertion through said hole, said cord extending axially through said leg, said annular second wall, said leg and said first annular ridge formed in one piece of plastic.

6. The window jamb of claim 5 comprising:

said convex face being radially larger than the hole.

7. The window jamb of claim 5 comprising:

said radially extending annular second wall extending over and configured for contacting a first side of the first wall of the vertical track, and said first annular ridge extending over and configured for contacting a second side of the first wall of the vertical track.

8. The window jamb of claim 7 comprising:

an annular shoulder on said radially extending annular second wall, forming a surface facing and spaced from said first side for receiving a prying tool.

9. The window jamb of claim 5 comprising:

a radially extending second annular ridge in said hole, formed in one piece with said annular second wall, said leg and said first annular ridge, spaced from said annular second wall and from said first annular ridge.

10. A sash balance shoe adapted for moving along a window jamb track comprising a vertical wall having a first hole through the wall, said shoe comprising:

means for attaching said shoe to a sash, a cord having a first end, extending from said shoe, means for drawing said shoe cord toward said shoe, a one-piece plastic button comprising a leg having a first diameter smaller than the hole, a first end, a second end, and an axis, mounted on the first end of said cord, a first annular ridge extending radially from said leg, having a diameter larger than said hole, beveled and flexible enough for insertion through said hole, a radially extending annular wall on said leg, having a diameter larger than said hole, spaced from said ridge so that when said shoe is mounted on said track hanging from said cord and said leg is in said hole said button is prevented by said annular wall in contact with a first side of said vertical wall, from being pushed through said hole, and is prevented by said annular ridge in contact with a second side of said vertical wall from being pulled from said hole by said cord.

11. The sash balance shoe of claim 10 comprising:

a second annular ridge extending radially from said leg, between said first annular ridge and said radially extending annular wall, having a diameter larger than said hole.

12. The sash balance shoe of claim 10 comprising:

a convex surface on said radially extending annular wall having a diameter larger than said hole.

13. The sash balance shoe of claim 12 further:

an annular shoulder on said annular wall having a smaller diameter than the annular wall, forming an axially facing surface that is spaced from the first side for receiving a prying tool when the button is in the hole.

* * * * *